US005908241A

United States Patent [19]

Bliss et al.

[11] Patent Number: 5,908,241

[45] Date of Patent: Jun. 1, 1999

[54] COIL IMPELLER MIXING DEVICE

[75] Inventors: Richard W. Bliss, Great Falls, Va.; William R. Bliss, Newark, Del.

[73] Assignee: Spyral Corporation, Washington, D.C.

[21] Appl. No.: 09/059,296

[22] Filed: Apr. 14, 1998

[51] Int. Cl.[6] ..... B01F 7/24

[52] U.S. Cl. ..... 366/129; 366/325.6; 416/227 R

[58] Field of Search ..... 366/64–66, 96–98, 366/102–104, 129, 262–265, 292, 325.3, 325.6, 326.1, 327.1, 331, 342, 343, 605; 416/1, 176, 207, 208, 214 R, 219 R, 220 R, 220 A, 227 R, 227 A

[56] References Cited

U.S. PATENT DOCUMENTS

| | | | |
|---|---|---|---|
| D. 362,793 | 10/1995 | Khan et al. . | |
| 647,341 | 4/1900 | Tutt | 366/129 |
| 781,917 | 2/1905 | Smith | 366/129 |
| 1,223,839 | 4/1917 | Turner | 366/129 |
| 1,227,327 | 5/1917 | Sheaffer | 416/176 |
| 1,627,315 | 5/1927 | Boynton | 366/129 |
| 2,278,398 | 3/1942 | Wittmann | 366/325.6 |
| 2,670,938 | 3/1954 | Wittmann | 366/325.6 |
| 2,733,900 | 2/1956 | Wobensmith | 416/176 |
| 3,132,849 | 5/1964 | Kritikson . | |
| 3,185,451 | 5/1965 | Snyder | 416/416 |
| 4,558,520 | 12/1985 | Forde Jr. . | |
| 4,575,255 | 3/1986 | Kafka . | |
| 4,591,389 | 5/1986 | Everitt . | |
| 4,811,867 | 3/1989 | Deyle, Jr. et al. . | |
| 5,037,210 | 8/1991 | Bliss | 366/343 |
| 5,482,367 | 1/1996 | Khan et al. | 366/129 |

*Primary Examiner*—Charles E. Cooley
*Attorney, Agent, or Firm*—Edward J. Kondracki; Kerkam, Stowell, Kondracki & Clarke, P.C.

[57] ABSTRACT

A mixing device for mixing flowable materials in a container employs an elongated shaft having one end adapted to be connected to a power source and the other to be inserted into the material, with a pair of elongated, generally helical open centered coil impellers mounted on the shaft at a location to be submerged in the material, with the coils having their longitudinal axes parallel to one another and substantially perpendicular to the shaft, with the coils being offset on opposite sides of the shaft. Preferably, the coil impellers are supported on a hub mounted for adjustment longitudinally of the shaft.

20 Claims, 8 Drawing Sheets

COIL IMPELLER MIXING DEVICE

BACKGROUND OF THE INVENTION

1. Field of the Invention

This invention relates to mixers for mixing flowable materials, and more particularly to an improved coil impeller mixing device which is very effective and efficient in mixing flowable products including highly viscous liquids such as petroleum distillation sludges, tars and the like, as well as for blending solids such as powdered materials into liquids, reducing particle size in blends (through impact in the mixing process) and for the processing of products such as foods, paint, polymers, ceramics, cosmetics, drugs and other products.

2. Description of the Prior Art

Mixing operations are so well known and widely used that little consideration is given to the subject by the average individual. At the same time, effective and efficient mixing is critical in the production and/or use of numerous products. A very substantial mixing industry has developed involving both domestic and industrial mixing devices and operations, and mixers ranging from small "test tube" models to large industrial process mixers requiring 300 horsepower or more are commercially available. It has been estimated that the industry's total annual revenue in this country alone may be as much as 1.2 billion dollars.

Industrial mixers typically employ impellers in the form of propellers, pitched blades, Rushton blades, bottom scraper blades, or high speed dispersers, emulsifiers. It is also well known to employ an elongated coil impeller supported on the end of a shaft driven by a drill motor or the like, and a device of this type is disclosed in U.S. Pat. No. 5,037,210. In this prior art device, the coil is loosely mounted on a drive shaft to enable the longitudinal axis of the coil to be deflected at a substantial angle from a plane perpendicular to the drive shaft axis. This feature enables the coil to contact the bottom of a container, for example a paint can, along the full length of the coil even though the drive shaft is not held perpendicular to the can bottom.

U.S. Pat. No. 3,132,849 also discloses a stirrer, or mixer, including a coil scraping and stirring element adapted to contact the bottom of a container while being driven about an axis substantially perpendicular to the bottom of the container. This device is intended for use primarily to prevent food from sticking to the bottom of the container during cooking and it does not employ the pumping feature of a relatively high speed impeller for mixing or homogenizing the entire contents of the container.

While the mixer industry has developed mixing technologies adequate for most industrial or commercial mixing and blending operations, many of these devices are relatively cumbersome, inefficient, and maintenance intensive, and frequently do not reliably produce the high quality uniform product desired, or require excessive time for producing the desired mixing action.

The known mixers have not been considered adequate for some operations such as removing sludge settled on the bottom of the large petroleum tanks at refineries and it is currently necessary to put such tanks out of operations periodically to be cleaned by hand. Also, some of the known mixing devices are not energy efficient and are not readily adaptable to variable conditions such as product depth in the mixing container. Accordingly, it is a primary object of the present invention to provide an improved coil impeller mixing device which is highly efficient and effective in mixing flowable products.

Another object is to provide such a mixing device which produces a highly uniform mixed product.

Another object is to provide such a mixing device which is capable of mixing products having a wide range of viscosities.

Another object is to provide such a mixing device which is highly effective in disbursing dry or powder materials in a liquid.

Another object is to provide such a mixing device which can readily be adjusted for effectively mixing materials of various depths in a mixing container.

Another object is to provide such a mixing device which can efficiently reduce particle size (through impact within the mixing container) in the material being mixed.

Another object is to provide such a mixing device which can process large solid and semi-solid masses into a fluid form without damage to the device.

SUMMARY OF THE INVENTION

The foregoing and other objects are achieved in accordance with the present invention by a mixing device including a plurality of elongated coil shaped impellers each mounted in an offset relation to the longitudinal axis of a drive shaft and each having its central portion fixed to the shaft for rotation in a plane substantially perpendicular to the longitudinal axis of the shaft. Each coil shaped impeller is formed from a continuous length of rod-shaped material such as a stainless steel wire or rod formed into a substantially helical configuration with the pitch of the helix being between 0.8 and 1.6 times the diameter of the rod-shaped material measured longitudinally of the coil.

Each coil has an open center extending its full length, with the longitudinal axis of the open center lying in a plane substantially perpendicular to the longitudinal axis of the drive shaft, with the coil terminating in open ends.

Each coil-shaped impeller is mounted at its midsection to a mounting hub which, in turn, is supported on the drive shaft, and means is provided for adjusting the axial position of the hub on the shaft to thereby permit the most efficient positioning of the impellers within the material to be mixed. At least one pair of coil-shaped impellers is employed, and the coils of each pair may have their longitudinal axis lying in a common plane perpendicular to the longitudinal axis of the shaft, or may be offset longitudinally of the drive shaft with respect to one another. When more than one pair of impellers are employed, the impellers of each pair are substantially parallel, but the impellers of the respective pairs may have their longitudinal axes disposed at an angle, for example 90 degrees, with respect to the coils of another pair. The coils of each pair are laterally offset substantially the same distance from the axis of the shaft to provide balance to the mixing assembly.

BRIEF DESCRIPTION OF THE DRAWINGS

Other features and advantages of the invention will be apparent from the detailed description contained herein below, taken in conjunction with the drawings, in which.

DESCRIPTION OF THE PREFERRED EMBODIMENTS

Figure 1:
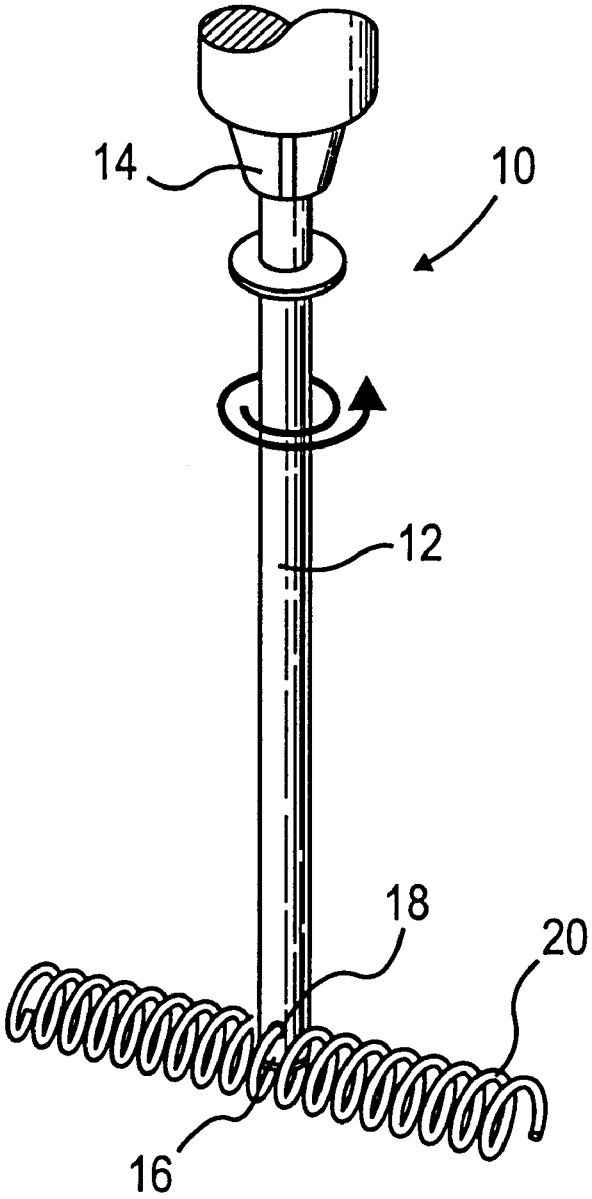
FIG. 1 PRIOR ART
FIG. 1 is a fragmentary isometric drawing of a prior art coil impeller mixer.

Referring now to the drawings in detail, a prior art helical coil impeller mixer of the type disclosed in the above mentioned U.S. Pat. No. 5,037,210 is illustrated in FIG. 1 and designated generally by the reference numeral 10. The mixer 10 comprises an elongated drive shaft 12 having a first end connected, as by a chuck 14 of a suitable drive device such as a hand held drill (not shown) or fixed motor drive assembly for rotation about its longitudinal axis. The shaft 12 has a free end 16 which is inserted into the material to be mixed, and a transversely extending hole 18 is formed in the shaft adjacent its free end.

An elongated helical coil impeller 20 is supported on the free end of the shaft by threading one end of the helical coil through the hole 18 and turning the coil about its longitudinal axis until the hole 18 is located at the midpoint of the elongated coil, i.e., midway between its two opposed open ends. This mounting arrangement, as described in U.S. Pat. No. 5,037,210, permits the coil impeller to pivot about the transverse axis of hole 18 to permit substantial misalignment between the axes of the drive shaft and the coil whereby the coil impeller can remain in continuous contact with the bottom of a container despite the drive shaft 14 being substantially inclined with respect to the container bottom. This arrangement is particularly effective in mixing or stirring relatively small quantities of product such as paint wherein pigments and the like have settled to the bottom of the container so that scraping movement of the coil over the bottom surface of the container effectively dislodges the highly viscous sediment.

U.S. Pat. No. 5,037,210 also discloses the use of one or more additional coil impellers mounted between the ends of the drive shaft with each such additional impeller being mounted so that its longitudinal axis is perpendicular to the shaft axis and passes through an imaginary plane passing through and parallel to the shaft axis. The mounting of the additional impellers is the same as the one on the free end of the shaft except that a pair of coil loops of the additional impellers engage the shaft and presumably would prevent pivotal movement of the coils to thereby maintain the perpendicular arrangement.

Figure 2:
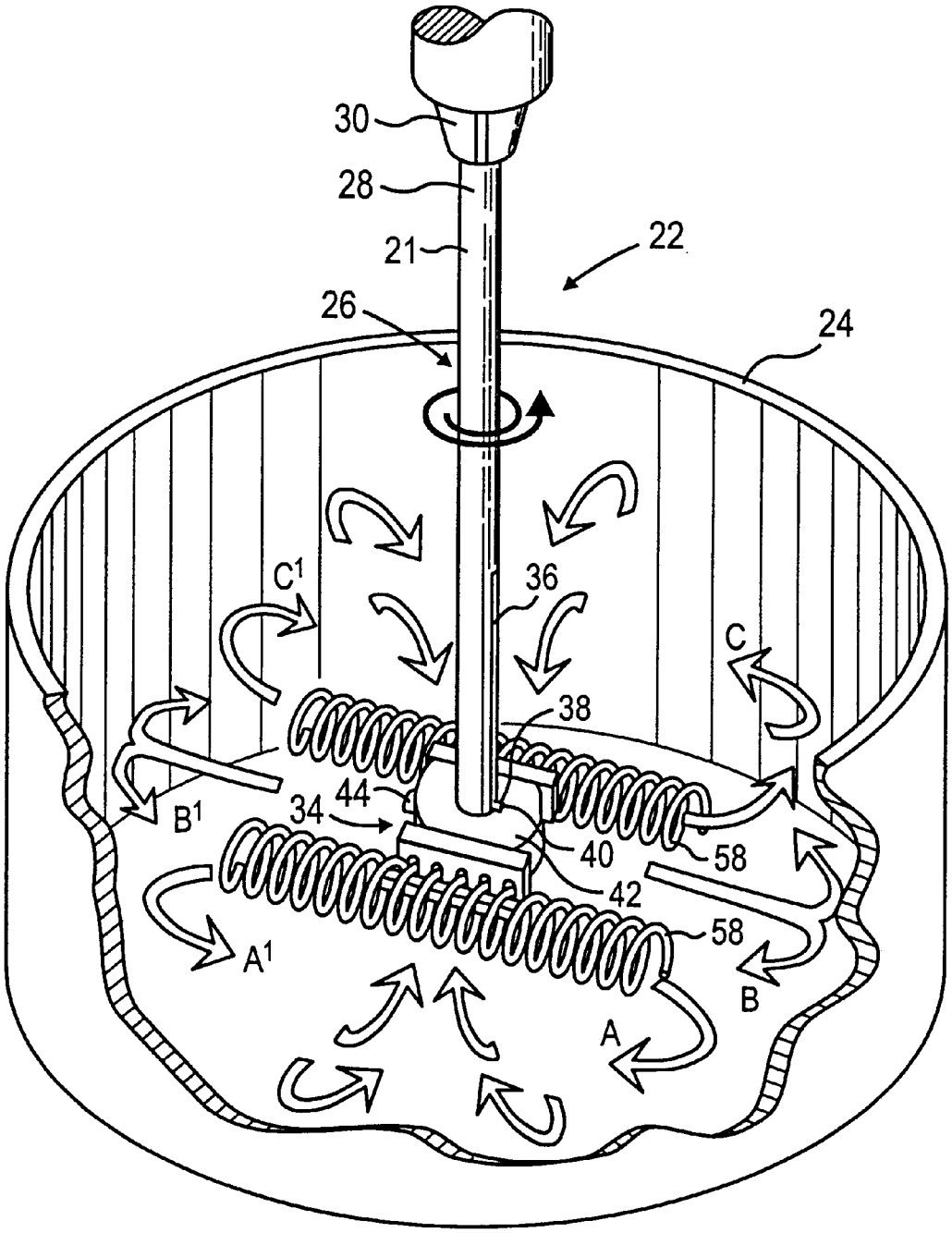
FIG. 2 is a view similar to FIG. 1 and illustrating an improved mixer according to the present invention in use for mixing product in a container.

The mixing device of the present invention, indicated generally by the reference numeral 22, is illustrated schematically in FIG. 2 as being employed to mix product in a container 24. As in the prior art device, the mixer of the present invention includes an elongated drive shaft 26 having a first end 28 adapted to be coupled to and driven by a suitable drive means indicated generally at 30.

Figure 7:
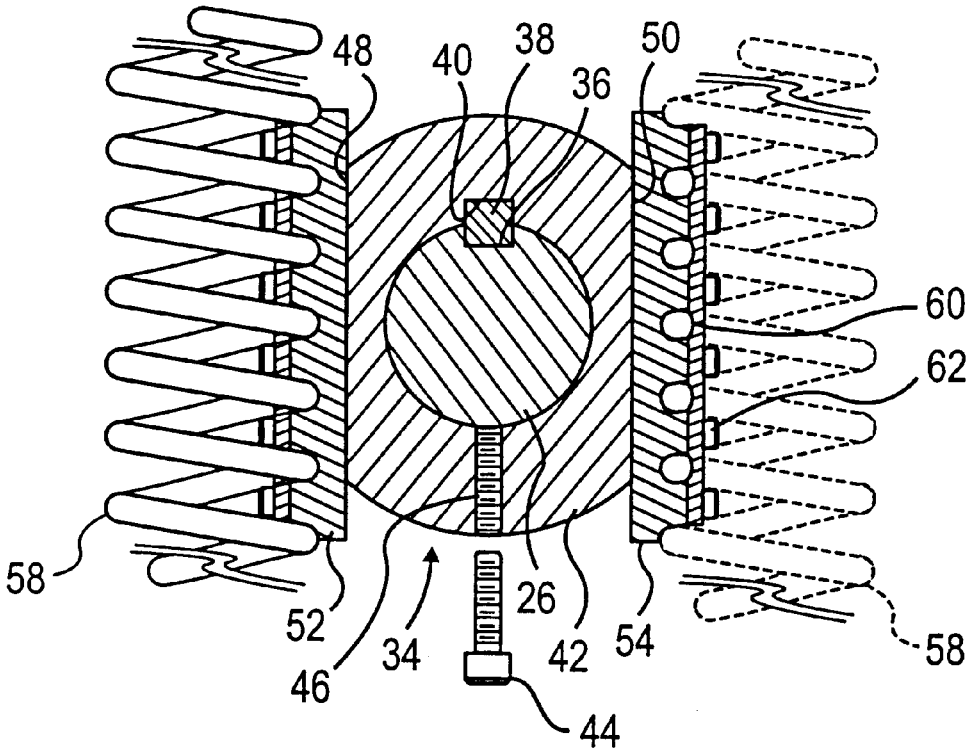
FIG. 7 is an enlarged fragmentary sectional view of an impeller and hub assembly, showing means for mounting the assembly on a shaft.

The other end portion 32 of shaft 26, i.e., the bottom end portion, is located within the container 24 during the mixing operation, and has supported thereon an impeller mounting hub 34. As best seen in FIGS. 2 and 7, shaft 26 is formed with an axially extending key way 36 in its outer cylindrical surface for receiving a key 38, with key 38 projecting radially into a key slot 40 in the body 42 of hub assembly 34. Thus, key 38 fixes the hub against rotation relative to the shaft 26 while, at the same time, the elongated key slot 36 enables adjustment of the hub assembly axially along the shaft from the position adjacent the bottom end portion 32 as shown in FIG. 2 to any desired position along the shaft as permitted by the slot 36. A set screw 44 extends through a threaded passage 46 in the hub body 42 at a location substantially diametrically opposite the key way 40 to engage the outer surface of shaft 26 to axially fix the hub at the desired location as will be described more fully herein below.

Still referring to FIGS. 2 and 7, it is seen that hub body 42 has a pair of parallel planar surfaces 48, 50 formed thereon in diametrically opposed relation, and a pair of coil mounting blocks, or plates, 52, 54 are mounted one on each of the flat surfaces 48, 50 by suitable means as by welding or bolting. Blocks 52, 54 may be substantially identical, with block 52 being illustrated independently of the mounting hub in FIG. 9. Block 52 is a substantially rectangular plate, preferably formed of stainless steel or some other metal, having a plurality of grooves 56 formed in its outwardly directed surface the spacing of the grooves corresponds to the pitch of the coil loops with the respective grooves 56 being dimensioned and oriented to receive a portion of successive individual coil turns in the midsection of a substantially helical coil impeller 58, again as best seen in FIG. 7. Preferably, the grooves 56 have a depth into the body of block 52 which is slightly less than the diameter of the wire or rod employed to form the coil 58.

While the coils are illustrated in the drawings as being formed from a rod or wire of circular cross section, it is to be understood that other configurations could be used. For example, a triangular or Wedgewire configuration may be used, in which case, one apex of the triangular shape would define the outer circumference of the coil and a continuous smooth side of the triangle would extend around the inner surface of the coil to reduce fluid friction and promote axial flow of product therethrough.

Figure 8:
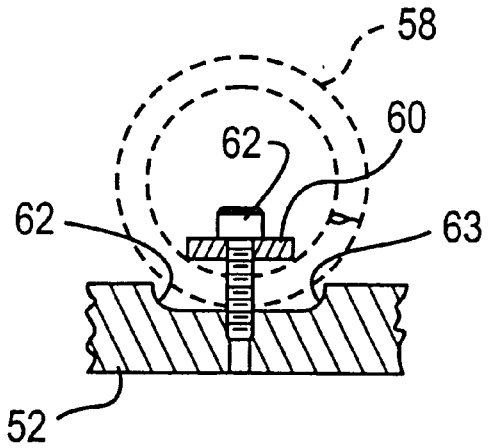
FIG. 8 is an enlarged fragmentary sectional view of a portion of the structure shown in FIG. 7.

An elongated clamping bar 60 is positioned within the open center of each of the coils 58, and a plurality of mounting bolts or screws 62 extend through openings 64 in the clamping plate and into threaded openings 64 and mounting blocks 52, 54 to firmly clamp the coil impellers 58 in position along the hub assembly. By providing grooves 56 which have a depth slightly less than the diameter of the wire forming coils 58, the clamping plates 60 will engage and apply a firm clamping of force to the respective coils upon tightening the bolts 62. Also, the grooves 56 preferably do not run the full length of the mounting block 52, but rather terminate in a shoulder 63 to engage the individual coil loops at a location spaced along the grooves from the clamping plate to further provide strength and stability to the clamped assembly as shown in FIG. 8. However, in some applications, the grooves are full length. The clamping arrangement thus provides a rigid assembly which is not subject to wear as a result of stresses applied to the coil impellers during operation.

Figure 9:
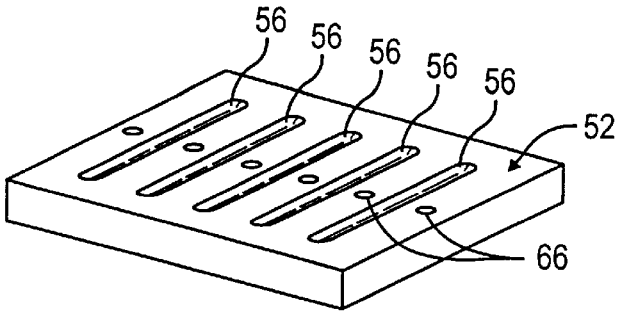
FIG. 9 is an isometric view of a portion of the structure shown in FIG. 7.

While the grooves 56 illustrated in FIG. 9 appear to extend substantially parallel to the vertical side edges of the mounting block 52, but preferably these grooves are inclined as shown in FIG. 9 to accommodate the pitch angle of the spiral coil fitting within the grooves. This angle will, of course, depend on the pitch of the coil. Alternately, the individual grooves 56 may have a transverse width which is slightly greater than the diameter of the coil wire element, thereby accommodating the angle of inclination of the grooves while still engaging the coil loop positioned therein to accurately position and stabilize the coil. In this latter arrangement, one side of a loop would engage a groove adjacent one end thereof and the opposite side of that loop would engage the opposite side of the groove adjacent the other end thereof.

Figure 10:
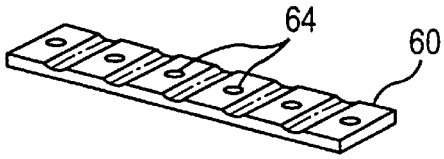
FIG. 10 is an isometric view of a clamping bar used in the assembly of FIG. 7.
Figure 11:
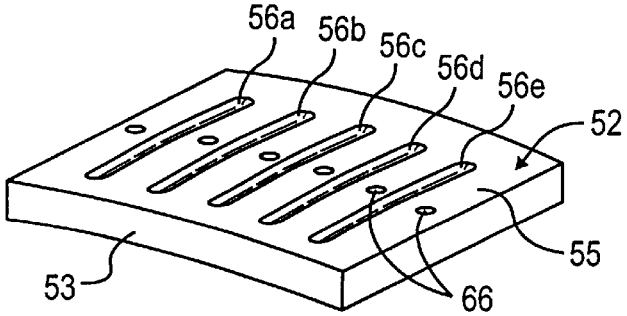
FIG. 11 illustrates an alternate embodiment mounting of the structure shown in FIG. 9.
Figure 12:
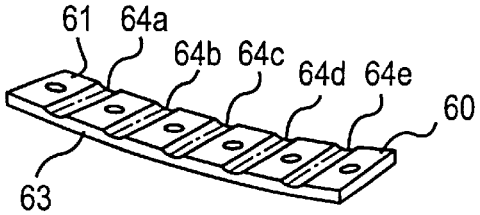
FIG. 12 illustrates an alternate embodiment of the clamping bar shown in FIG. 10.

FIGS. 11 and 12 illustrate an alternate embodiment of the mounting block 52, 54 and clamping bar 60 shown respectively in FIGS. 9 and 10. As shown in FIG. 11, block 52 has an arcuate under surface 53, preferably shaped to accommodate the outer surface of the hub 42. To this end, the flat surfaces 48, 50 of hub 42 may be milled to ensure that a substantial portion of the arcuate undersurface 53 engages the milled outer surface 48,50 of block 52. The upper surface 55 of block 52 may be flat as shown in FIG. 9 or, if desired, may include an arcuate surface as shown in FIG. 11. In that event, the outer grooves 56*a* and 56*b* are canted or face slightly outward in a first direction, while grooves 56 and 56*c* face slightly outward in the opposite direction, with groove 56*c* having a neutral position parallel to an imaginary plane passing perpendicular to the place 52 and through the groove 56*c*. The effect of the canted grooves is to give a droop to the outer ends of the coils, thus bringing the two adjacent ends of the spaced coils mounted on a shaft closer to each other and causing the outflow pattern of each coil to be directed slightly inward toward the outflow radial pattern. When using an arcuate plate as shown in FIG. 11, a correspondingly arcuate shaped clamping bar 60 is used having arcuate surfaces 61, 63.

Figure 14:
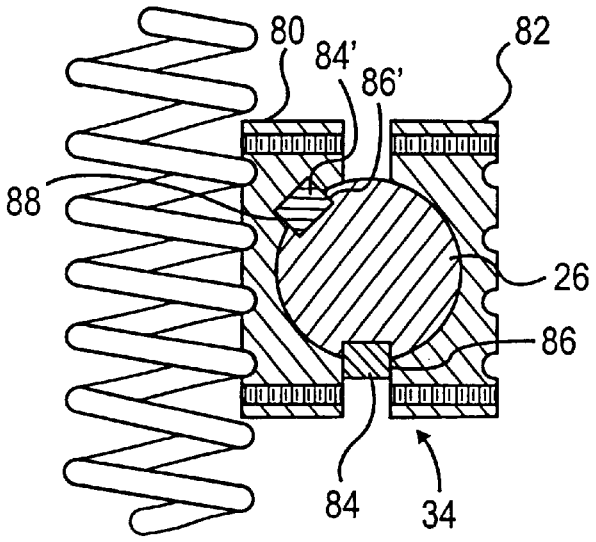
FIGS. 14 and 15 are enlarged fragmentary sectional views of hub assemblies showing alternative arrangements for mounting a coil impeller to the hub.
Figure 15:
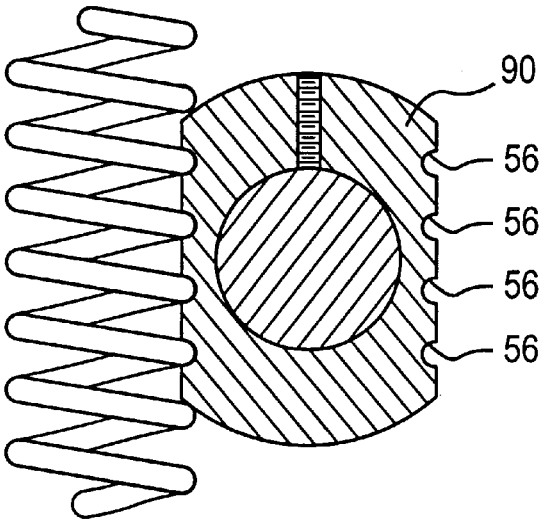

FIGS. 14 and 15 illustrate alternate embodiments of the hub assembly. In FIG. 14, the hub assembly 34 is in the form of a split drive hub comprising a first and a second hub member 80,82 adapted to be mounted diametrically opposite each other on shaft 26 and held thereon by suitable fasteners passing through the clamping bars (not shown) used to clamp the coils in position. A key 84 positioned between the members 80,82 and in key slot 86 fixes the members 80, 82 in place on shaft 26. Alternatively, one of the members 80,82 may include a key slot. As shown in FIG. 14, key slot 88 is provided in member 80 and a key 84' positioned in key slot 88 and shaft key slot 86' fixes the member in place on the shaft 26, the split drive hub accommodates out of round or damaged shafts and can also be utilized in those situations where a shaft may have something fixed on its end so as to prevent a coupling hub from being slipped over its end. As shown in FIG. 14, the grooves 56 for receiving the coil are machined directly into the hub so as to avoid the necessity of mounting plates 52 used with the arrangement of FIG. 7.

FIG. 15 illustrates an alternate embodiment of a hub assembly with grooves 56 machined in the end faces. The coils are mounted directly in the grooves 56 of hub 90 and held fast by clamping bars 52 (not shown) in FIG. 15.

By providing two coil impellers in equally spaced parallel relation one on diametrically opposed sides of the longitudinal axis of shaft 26, the impellers may be offset along the shaft without producing imbalance in the impeller system during normal operating speeds and loads. Also, by mounting two coil impellers with their axes in the same plane perpendicular to the longitudinal axis of shaft 26, an increased radial flow pumping action can be achieved in a radial plane to thereby increase the mixing action. Further, the two coil impellers, rotating in the fluid to be mixed, will produce a draft effect for each other, thereby reducing to some extent the amount of energy required.

By positioning the impeller hub assembly at the optimum depth in the fluid to be mixed, the high volume radial flow produced by the pumping action of the coil impellers will produce a large control vortex centrally within the container 24, along the axis of shaft 26, with the flow pattern extending from the open ends of each of the coil impellers and the space therebetween to a point adjacent the sidewalls of the container, where it will in effect be divided with a portion of the flow being diverted upwardly and a portion downwardly along the container walls. The divided flow then flows radially inward at the top surface of the product being mixed and along the bottom wall of the container toward the axis of rotation of the mixer, then axially back toward the impellers to again be drawn into the low pressure area created by the pumping action of the rotating impellers. The material will then be drawn again through the space between adjacent loops of the coil impellers and expelled from the open ends thereof to produce a highly efficient mixing action throughout the entire volume of product in the container.

By locating two impellers in a substantially horizontal common plane perpendicular to the shaft axis, with each impeller being spaced from the shaft, the discharge from the opposite open ends of the coil pair and the space therebetween produces a relatively wide (circumferentially) low radial stream made up of three distinct flow patterns A, B and C directed outwardly toward the container wall. This flow pattern appears to facilitate an enhanced vortex action and an unexpected enhanced mixing substantially greater than what would be expected from the mere addition of one coil, i.e., the total radial flow is substantially greater than the sum of the radial flow from each coil. Offsetting the coils slightly vertically produces a similar action. The cooperate effect of the coils in increasing the outward radial flow diminishes as the separation between the coils increases.

Depending upon the nature of the product being mixed, the size of the container, and the depth of the product in the container, it may be desirable to provide vertically extending baffles along the inner surface of the container wall at spaced intervals therearound, to thereby minimize any tendency towards circumferential flow and assure the desired high velocity, high volume double vortex flow.

The apparent synergistic effect achieved by providing two coil impellers in laterally offset relation to the axis rotation of the drive shaft is not fully understood, although it is believed that, in addition to the "drafting" effect mentioned above, an increase in the shear effect in the product in the vicinity of and through the coils, and by the increased outward flow produced by the laterally offset impellers creating greater turbulence in the fluid without producing cavitation or other flow characteristics which will disrupt the desired vortex flow. In effect, a triple vortex is formed which combines into a single large central vortex parallel to the shaft to facilitate mixing.

Tests conducted on mixing system substantially as described above with respect to FIG. 2 in a transparent container, and employing a translucent fluid with insoluble visible particles therein, clearly demonstrate the triple vortex flow achieved throughout the mass in the container. It has been found that this triple vortex, relatively high velocity flow produces an extremely efficient mixing action, which is believed to be due to the relatively high shear action of the fluids in such a flow pattern. The total flow is substantially greater than the sum of the flow from the two coils and it is believed that the tandem rotating coils in effect cause a side wall to be created defining an area of material therebetween which is ejected radially upon rotation of the coils in a manner similar to the ejection of material within the coil.

Figure 13:
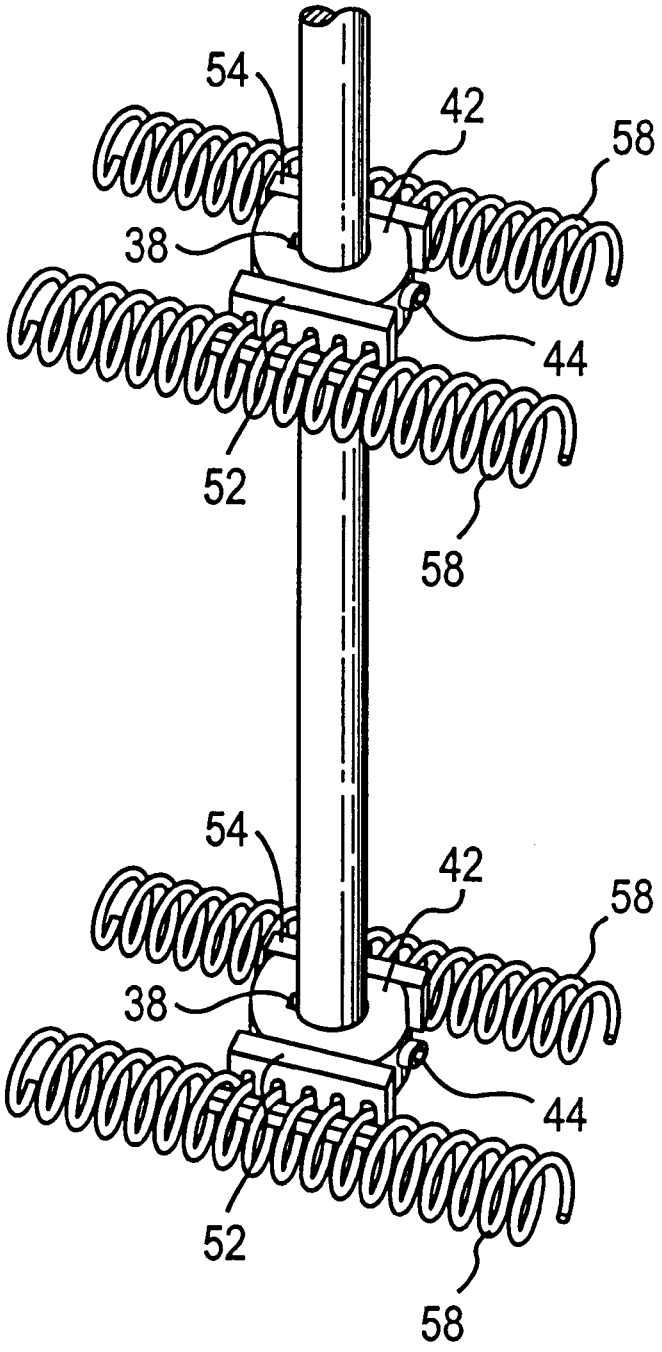
FIG. 13 is an isometric view of an embodiment of the invention including a plurality of coil impeller and hub assemblies mounted on a drive shaft.
Figure 16:
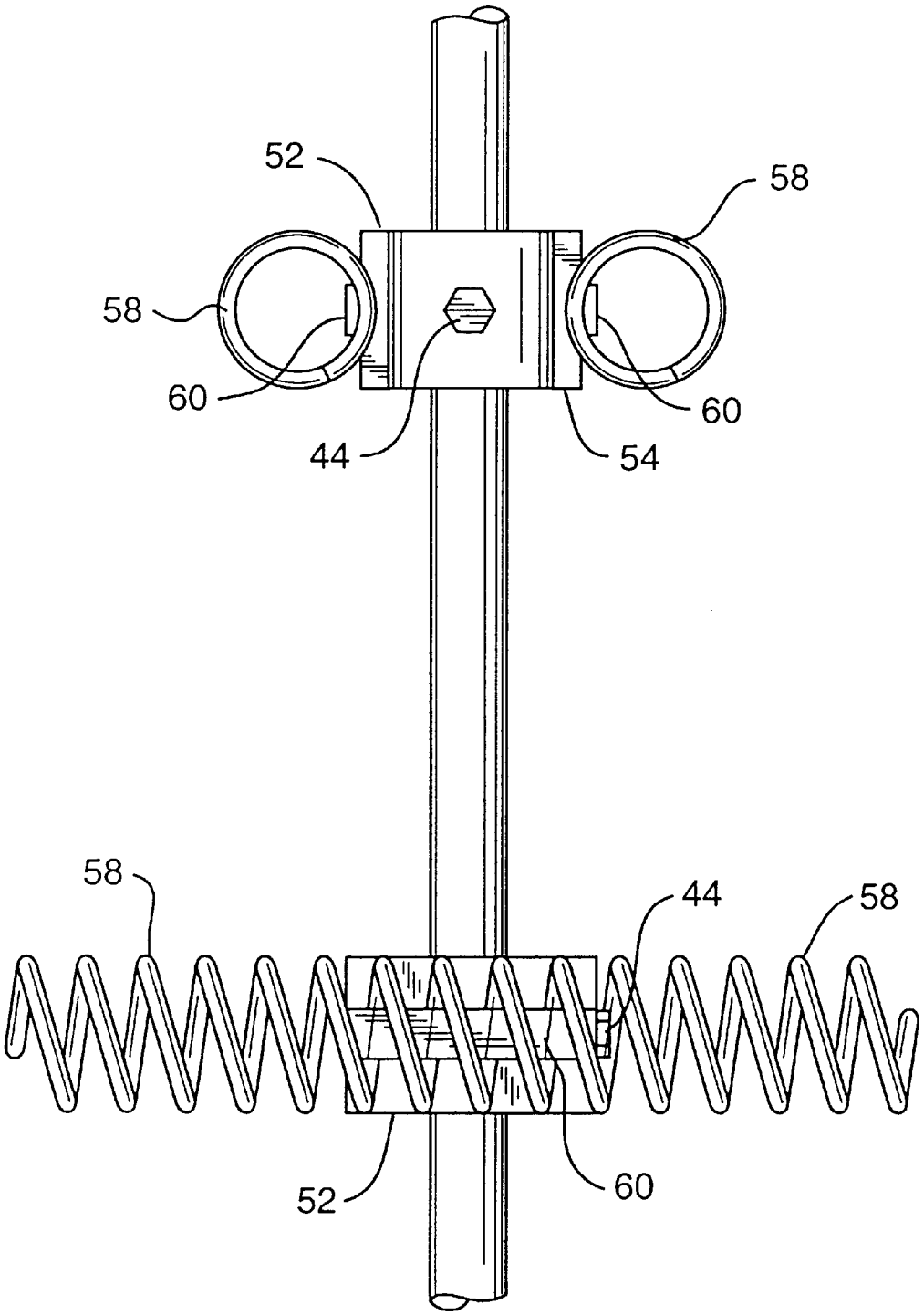
FIG. 16 is a isometric view of an alternate embodiment of the coil arrangement of FIG. 13, with the axes of the second pair of coils offset circumferentially of the shaft from the longitudinal axes of the first pair of coils.

It has also been found that when products are mixed in a relatively deep container, multiple vortex flow patterns can be achieved by utilizing a plurality of pairs of offset coil impellers, as described above, at spaced axial positions along the shaft 26 as shown in FIGS. 13 and 16. The arrangement of FIG. 16 differs from that of FIG. 13 in that the longitudinal axes of the second pair of elongate coils, i.e. the upper pair as shown in FIG. 16, are offset circumferentially of the shaft from the longitudinal axes of the first pair of elongated coils, i.e. the lower pair is viewed in FIG. 16. The coils of each pair lie in a common plane perpendicular to the longitudinal axis of the shaft.

Figure 3:
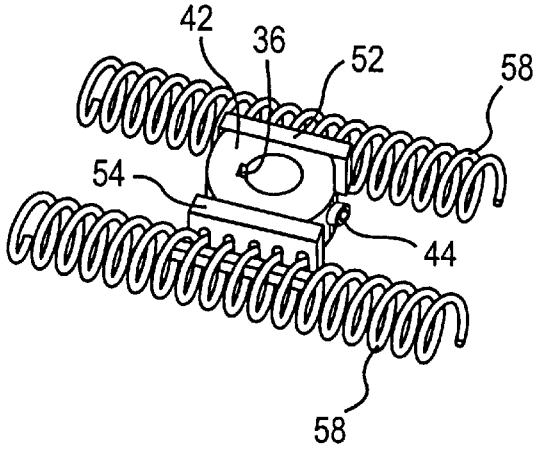
FIG. 3 is an isometric view of a pair of substantially cylindrical helical impeller coils supported on an impeller hub for mounting on a drive shaft.
Figure 4:
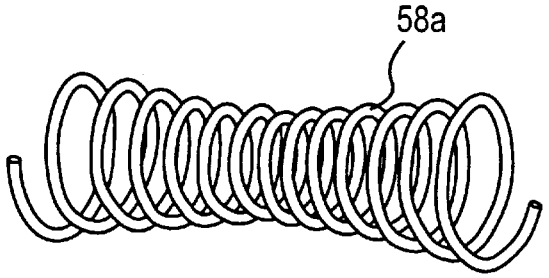
FIG. 4 is an isometric view of an alternate embodiment of the coil shaped impeller in which the coil is larger adjacent its open ends than at its central portion.
Figure 5:
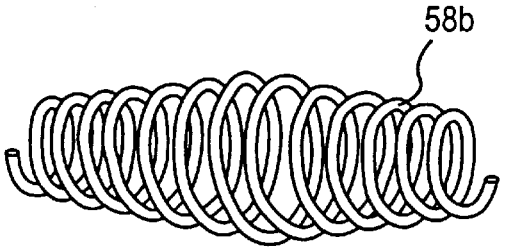
FIG. 5 is a view similar to FIG. 4 and showing another coil configuration useful in the invention.
Figure 6:
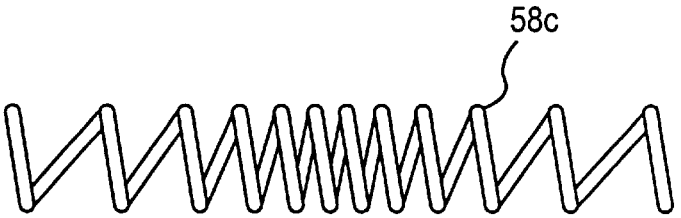
FIG. 6 is a plan view of a further embodiment of the coil impeller in which the pitch of the coil varies along its length.

In the preferred embodiment of the invention, the coil impellers are in the form of substantially straight, cylindrical helical coils, either of uniform pitch as shown in FIGS. 2, 3 and 11, a nonuniform pitch may be employed as shown at 58C in FIG. 6. Also, the coils may vary in size (diameter) along their length such as the "bow tie" configuration 58*a* in FIG. 4 wherein the ends of the coil are of greater diameter than the midsection, or the barrel configuration 58*b* shown in FIG. 5 wherein the ends of the coil are of smaller diameter than the midsection. The nature of the product being mixed, as well as the size of the container in which the material is to be mixed, will determine the most efficient configuration for the coil. It should be understood, however, that the term "generally helical" as used in the specification and claims hereof, should be interpreted so broadly as to include the various coil configurations illustrated as well as combinations thereof. It should also be understood that the pitch of the coils will vary with the characteristics of the product to be mixed, with the coil always having a pitch which is between 0.8 and 1.6 times the diameter of the wire or rod from which it is made. In this regard, the term diameter is intended to include the maximum transverse dimension of the rod measured in a direction parallel to the axis of the coil regardless of whether the wire or rod is of circular or other cross section.

The length and diameter of the coils will also vary depending on the nature of the product being mixed. For small test tube mixers, the shaft may have a diameter in the range of about ⅛ inch and the coils have a length of ¼ to ⅜ of an inch. By contrast, for large industrial mixers for use in mixing very viscous material, the coils may be formed from a 1 inch (or larger) diameter high strength stainless steel or steel wire and have an overall length of 48 inches or more. In each case, the shearing action of the product flowing between adjacent coils, and the flow direction changes both into and through the coils and in the double vortex flow patterns produces a highly efficient and effective mixing action requiring a minimum of energy for driving the impellers.

While preferred embodiments of the invention have been disclosed and described, it should be understood that the invention is not so limited, but rather that it is intended to include all embodiments thereof which would be apparent to one skilled in the art in which come within this spirit and scope of the invention.

We claim:

1. A mixing device for mixing flowable material in a container, comprising an elongated shaft having a first end adapted to be attached to a power source for rotation about its longitudinal axis and a second end to be inserted into material to be mixed, a first pair of elongated, generally helical open centered coils each having a central longitudinal axis and open ends, said coils each being formed from a length of substantially rigid rod-like coil material with the pitch of the helix being between 0.8 and 1.6 of the maximum cross sectional width of the coil, measured parallel to said axis of the coil, to thereby provide an open space between adjacent coil loops, coupling means including a first hub mounted on said shaft in spaced relation to said first end for rotation therewith, said first hub including coil supporting means engaging each said elongated coil of said first pair at a location equally spaced from said open ends, and coil clamping means located within each said coil and engaging the open center of each said coil, said clamping means including fastener means extending through the space between adjacent coil loops and engaging said first hub to clamp said coils in fixed position on said first hub in spaced, parallel relation to one another and in laterally offset relation to said longitudinal axis of said shaft one on each side thereof with the longitudinal axis of each said coil being in a plane substantially perpendicular to the longitudinal axis of said shaft and with said open ends being substantially equally spaced from said longitudinal axis of said shaft.

2. The mixing device as defined in claim 1 wherein said first hub is releasably mounted on said shaft and located adjacent said second end of said shaft.

3. The mixing device as defined in claim 2 wherein the longitudinal axes of said first pair of coils lie in a common plane perpendicular to said longitudinal axis of said shaft.

4. The mixing device as defined in claim 2 further comprising a second hub mounted on said shaft between said first and second ends thereof and in axially spaced relation to said first hub, and a second pair of elongated generally helical open centered coils mounted on said second hub for rotation therewith about said longitudinal axis of said shaft, said second pair of coils being mounted in spaced parallel relation to one another, one on each side of said shaft and in laterally offset relation thereto.

5. The mixing device defined in claim 4 wherein the longitudinal axes of said second pair of elongated coils are offset circumferentially of said shaft from the longitudinal axes of said first pair of elongated coils and lie in a common plane perpendicular to said longitudinal axis of said shaft.

6. The mixing device defined in claim 4 wherein said second hub is mounted for axial adjustment along the length of said shaft.

7. The mixing device as defined in claim 1 wherein said coil supporting means on said first hub comprises a plurality of grooves each adapted to receive and engage a portion of an individual coil loop of one of said elongated coils.

8. The mixing device defined in claim 7 wherein said grooves are inclined relative to said longitudinal axis of said shaft at an angle corresponding to the pitch angle of said first pair of coils.

9. The mixing device defined in claim 8 further comprising adjustable means mounting said first hub for movement axially along said shaft whereby the depth of said coils in said flowable materials to be mixed may be selectively adjusted without changing the axial position of said shaft.

10. The mixing device as defined in claim 9 wherein said adjustable means comprises a first elongated key way formed in and extending axially along said shaft and a second key way formed in said first hub, and a rigid key received in said first and second key ways to positively prevent relative rotation between said first hub and said shaft.

11. The mixing device as defined in claim 7 wherein said hub is split comprising two sections, each section containing a plurality of grooves, said two sections each having an inside surface conforming substantially to the surface of the shaft and means for locking said two sections to the shaft.

12. The mixing device as defined in claim 1 wherein the pitch of said coils varies between 0.8 and 1.6 times the maximum cross sectional width of the coil.

13. The mixing device of claim 12 wherein the diameter of said coils is substantially uniform throughout their length.

14. The mixing device of claim 1 wherein the diameter of said coils is larger adjacent the open ends of said coils than at the midsection of the coils.

15. The mixing device of claim 1 wherein the diameter of said coils is larger at the midsection than at the open ends.

16. A mixing implement comprising:

an elongated substantially rigid shaft having a longitudinal axis, a first end adapted to be connected to a power source for rotation about its longitudinal axis, and a second end;

a first pair of elongated coils each having an open center, first and second open ends, and a central longitudinal axis; and coupling means adapted to be mounted on said shaft and supporting said first pair of elongated coils in fixed spaced parallel relation to one another, one on each side of said longitudinal axis of said shaft and in outwardly spaced relation thereto, said coupling means including adjustable means for releasably but rigidly supporting said coils for rotation with said shaft about its longitudinal axis.

17. An improved method for mixing comprising the steps of immersing a substantially rigid shaft in a container containing material to be mixed, said shaft having a coupler affixed thereto and supporting at least first and second coils spaced apart from and substantially parallel to each other in a common plane transverse to a longitudinal axis of the shaft, said coils having a central longitudinal axis, the improvement comprising rotating said shaft about its longitudinal axis to cause said first and said second coils to rotate in said material about an axis of rotation substantially perpendicular to the central longitudinal axis of said coils at a sufficient rotational velocity so as to cause material within each coil and between the coils to be centrifugally ejected radially outward as the coils are rotated toward the inner surface of the container, thereby creating a plurality of low pressure areas within the material at locations adjacent to the coils and the area therebetween, said low pressure areas causing said material adjacent the coils and adjacent the area therebetween to be drawn into the coils and the areas therebetween and centrifugally ejected therefrom, and maintaining the rotational velocity of the coils until such time as the material has been mixed to the satisfaction of the user.

18. A method of mixing as set forth in claim 17 wherein rotation of the coils creates a plurality of vortices which combine in a central vortex adjacent the longitudinal axis of the shaft.

19. A method of mixing as set forth in claim 18 wherein at least three vortices are formed prior to combining into a central vortex.

20. A process for mixing materials within a container utilizing a shaft having a double coil element affixed thereto, said double coil element comprising a pair of spaced coils disposed in a common plane and extending transverse to the shaft, the improved mixing process comprising:

immersing the coils in the material to be mixed, rotating the coils with a sufficient velocity to cause material within and between the coils to be ejected radially outward and create a flow pattern in the container containing a plurality of vortices, a plurality of low pressure areas being formed adjacent and between the coils, said low pressure areas causing the material to be forcibly drawn into the coils and the area therebetween for continuous recirculation in the container, said plurality of vortices combining into a central major vortex which facilitates mixing upon continued rotation of said coils.

* * * * *